US007355580B2

(12) United States Patent
Shen et al.

(10) Patent No.: US 7,355,580 B2
(45) Date of Patent: Apr. 8, 2008

(54) METHOD OF INCREASING IMAGE GRAY-SCALE RESPONSE SPEED

(75) Inventors: Yuh-Ren Shen, Tainan (TW); Cheng-Jung Chen, Miaoli Hsien (TW)

(73) Assignee: Vastview Technology, Inc., Hsinchu (TW)

( * ) Notice: Subject to any disclaimer, the term of this patent is extended or adjusted under 35 U.S.C. 154(b) by 642 days.

(21) Appl. No.: 10/866,028

(22) Filed: Jun. 14, 2004

(65) Prior Publication Data

US 2005/0275645 A1 Dec. 15, 2005

(51) Int. Cl.
*G09G 3/38* (2006.01)

(52) U.S. Cl. ..... 345/98; 345/94

(58) Field of Classification Search ..... 345/87–103
See application file for complete search history.

(56) References Cited

U.S. PATENT DOCUMENTS 6,870,530 B2 * 3/2005 Bu et al. ..... 345/208
7,006,069 B2 * 2/2006 Tanaka et al. ..... 345/98

FOREIGN PATENT DOCUMENTS

JP 2001-166280 * 6/2001

* cited by examiner

*Primary Examiner*—Amr A. Awad
*Assistant Examiner*—Steven E Holton
(74) *Attorney, Agent, or Firm*—Lowe Hauptman Ham & Berner, LLP

(57) ABSTRACT

A method of increasing image gray-scale response speed comprising the following steps: to divide plural driven gate lines of an LCD into plural areas; to divide the frame interval time relative to the plural areas into plural sub-intervals, and to sequentially activate each first gate line of these areas during a time period of synchronized signals, then to sequentially activate the next gate lines of these areas, the operation is repeated; to apply an advance voltage to at least a gate line to overdrive frames, and to apply an image data voltage to at least a gate line; to repeat the above steps until the end of the entire frame interval time and to enter the next frame interval. The LCD can be fast driven by dividing of time and space. The method suits for treatment of frames of displays of various LCD's and organic light emitting diodes (OLED's).

10 Claims, 9 Drawing Sheets

METHOD OF INCREASING IMAGE GRAY-SCALE RESPONSE SPEED

BACKGROUND OF THE INVENTION

1. Field of the invention

The present invention is related to a method of increasing image gray-scale response speed, and especially to a method which divides a scanning area of an LCD into a plurality of areas, respectively applies an advance voltage to overdrive, or a data voltage to maintain the brightness of the data during a time period of synchronized signals, thereby to achieve an object of speeding up driving of the LCD and to increase the gray-scale response speed. The method suits for treatment of frames of displays of various LCD's and displays of organic light emitting diodes (OLED's).

2. Description of the Prior Art

In the earlier stage, people mostly are satisfied with that LCD's are light and without radiation. Following advancing of techniques and after appearing of LCD's of large sizes, LCD's are widely used in life and audio and video amusements, people gradually pay attentions to the requirements of the parameters such as of wide visual angle and response times. By the fact that it uses liquid crystal molecules as their basic elements in LCD's, such molecules of an intermediate state between the solid and the liquid states not only have the feature of being subjected to flowing by the action of an external force, but also have the feature of optical anisotropy specific for crystals, thereby they can make the arrangement of the crystals change to other directions by adding electric fields, and thereby result change of optical features during penetration of the light beams through the LCD's. Such a phenomenon of generating optical modulation by using added electric fields is called the photoelectric effect of LCD's.

Referring to FIGS. 1A and 1B showing a simple schematic view of the structure of an LCD, wherein the LCD panel 10 is provided thereon with source drivers 11 for converting adjusted gray-scale signal data into corresponding data voltages, and for outputting image signals through a plurality of data lines 111 of the source drivers 11 to the LCD panel 10. The LCD panel 10 is provided at a side thereof with gate drivers 12 for continuously supplying scanning signals, and for transmitting the scanning signals to the LCD panel 10 through a plurality of gate lines 121 connecting with the gate drivers 12; the data lines 111 cross perpendicularly to the gate lines 121. The area surrounded is a pixel matrix 13.

When the image signals are sent out of the source drivers 11, they provide a source electrode for a transistor $Q_1$ in the pixel matrix 13 through a data line $D_1$; and the gate drivers 12 also send out control signals relatively for a gate electrode of the transistor $Q_1$ through a gate line $G_1$. Then output an output voltage value through a circuit in the pixel matrix 13. A reaction of the liquid crystal molecules in correspondence with the pixel matrix 13 is activated, the liquid crystal molecules located between two glass base plates of the LCD panel 10 forms a parallel-plate capacitor of a liquid crystal $C_{LC}$. By virtue that the capacitor $C_{LC}$ is unable to keep voltage for the next time when it is to update frame data, hence a storage capacitor $C_S$ is added to render the capacitor $C_{LC}$ to keep the voltage for the next time when it is to update the frame data.

Superiority or inferiority of the performance of the LCD has an index-response time. Generally it has two conditions when there is no voltage applied to the LCD: a normally white (NW) mode and a normally black (NB) mode. The normally white (NW) mode means that a frame is pervious to light when the LCD panel 10 is not applied with a voltage, in which the frame is a bright frame. The normally black (NB) mode means that a frame is obscured when the LCD panel 10 is not applied with a voltage, in which the frame is an all-black frame. Taking the normally white (NW) mode as an example, the response time can be divided into two kinds:

(1) ascending response time: the twisting time required for the liquid crystal when the brightness of a liquid crystal box of the LCD is changed from 90% to 10% under application of a voltage, this is called in abbreviation as "$T_r$"; and (2) descending response time: the time required for the liquid crystal when the brightness of the liquid crystal box of the LCD is restored from 10% to 90% under application of no voltage, this is called in abbreviation as "$T_f$".

Generally, when the speed of displaying of the frames is over 25 frames/sec, human eyes will take the fast changing frames as continuous sequential pictures. In modern family amusements, for example, in playing DVD pictures of high quality or in playing games with fast moving frames, the speed of displaying of the frames is above 60 frames/sec. In other words, the frame interval time is 1/60=16.67 ms, if the response time of an LCD is larger than the frame interval time, there will be traces of residual images or skipping to seriously affect the quality of viewing images. As to how to increase the speed of response, it shall be counted on the factor that affects the response time. The followings are respectively the calculation formulas for the ascending response time $T_r$ and the descending response time $T_f$:

$$Tr = \frac{r_1 d^2}{\Delta\varepsilon(V^2 - V_{th}^2)}, \quad T_f = \frac{r_1 d^2}{\Delta\varepsilon V_{th}^2}$$

in which $r_1$ is a coefficient of viscosity of the crystal material; d is a gap of the liquid crystal box; V is a driving voltage of the liquid crystal box; and $\Delta\epsilon$ is a dielectric coefficient of the liquid crystal material.

We can see from the above equations that there are four ways to reduce the response time of the LCD: namely, lowering the coefficient of viscosity, reducing the gap of the liquid crystal box, increasing the driving voltage and increasing the dielectric coefficient. Wherein the technique of increasing the driving voltage is called as the technique of "overdrive" with which an integrated circuit driven by the liquid crystal (driver IC) transmits an increased voltage to a liquid crystal panel to increase the twisting voltage of the liquid crystal. Thereby the liquid crystal can be faster twisted and recovered to quickly get the desired brightness to be presented of the image data.

Referring to FIG. 2 showing variation curves of brightness versus time under different driving voltages, wherein $L_1$ is the desired brightness to be presented of the image data, the curve of data voltage $V_2$ presenting the desired brightness by driving the liquid crystal molecules is marked with 22, the time for getting this brightness is $t_0$. In order to reduce the time for getting this brightness, the variation of gray-scale brightness of the LCD measured in advance is referenced to provide a driving voltages $V_4$ with its strength increased, the curve is shown by the FIG. 24. Thereby the time $t_0$ for getting this desired brightness is reduced to $t_1$, and this is the method of "overdrive" technique.

The inventor of the present invention provided a brand new method of increasing image gray-scale response speed based on his professional experience of years in studying and developing in this art and using such a concept of "overdrive", in order to get a whole better effect of increasing the image gray-scale response speed.

SUMMARY OF THE INVENTION

The primary object of the present invention is to provide a method of increasing image gray-scale response speed. The method divides a plurality of gate lines of an LCD into a plurality of areas, and synchronically controls a plurality of scanning signals in a frame interval to sequentially activate gate lines of the areas, and to respectively apply an advance voltage or a data voltage to get a whole better effect.

To achieve the above object, the method of the present invention comprises:

a. to divide the gate lines of an LCD downwardly from above into M areas, the total number of the gate lines is Q, wherein the first area includes $m_1$ gate lines, the second area includes $m_2$ gate lines . . . the $M^{th}$ area includes $m_M$ gate lines, namely $$Q = \sum_{i=1}^{M} Pi,$$

wherein the ratio of the number $m_i$ of gate lines included in each area to the total number Q of the gate lines is $$Pi = \frac{m_i}{Q},$$

therefore, $$\sum_{i=1}^{M} Pi = 1,$$

the ratio Pi is set according to the features of the LCD, and can be set as a constant value or can be adjusted; M is an integer≧2, and ≦ the maximum value that the display panel can generate during a time period of synchronized signals, for the present technical level, M had better be a value between 2 and 6;

b. to divide the frame interval time T into M sub-intervals, wherein the interval time of each sub-interval is $t_i$=PiT, namely, $$\sum_{i=1}^{M} PiT = T;$$

c. to activate each first gate line of the first, the second . . . and the $M^{th}$ areas sequentially during a time period of synchronized signals; then to activate each second gate lines of the first, the second . . . and the $M^{th}$ areas sequentially during the next time period of synchronized signals; the operation is repeated, wherein K gate lines are applied by an advance voltage to overdrive frames to speed up response, and J gate lines are applied by an image data voltage; K and J are positive integers, satisfying the relation of K+J=M; the amounts K and J are related to the feature of response of the LCD, they can be decided by measuring and observing the curve of response in advance, while the advance voltage is obtained by measuring the variation of the gray-scale brightness of the LCD in advance;

d. the frame image in an $i^{th}$ area having been scanned has a time phase difference $t_i$ from a frame image in the former area $(i-1)^{th}$ area;

e. to repeat the above steps until the end of the entire frame interval time T to complete scanning of frame images.

With the above steps, through dividing of time (frame interval time) and space (gate lines), and by applying the advance voltage and the data voltage, we can fast drive the LCD to increase the image gray-scale response speed.

From the above statement, the present invention is characterized by dividing the area space of gate lines of a display panel into a plurality of areas, and dividing the frame interval time relative to the plural areas into a plurality of sub-intervals, and sequentially scanning the areas during the time period of synchronized signals, a state of "frame in frame" both in time and space is formed, the method of the present invention suits displays of various LCD's and organic light emitting diodes (OLED's).

The present invention will be apparent after reading the detailed description of the preferred embodiment thereof in reference to the accompanying drawings.

DETAILED DESCRIPTION OF THE PREFERRED EMBODIMENT

Figure 1A:
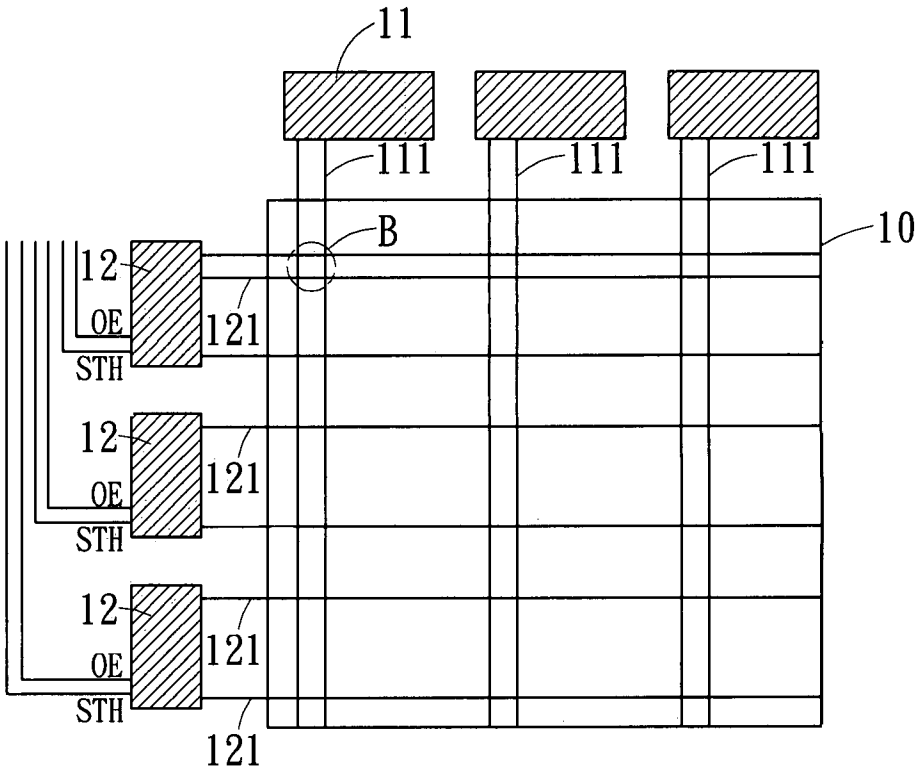
Fig. 1A (Prior Art)
FIG. 1A is a schematic view showing the simple structure of a conventional LCD.
Figure 1B:
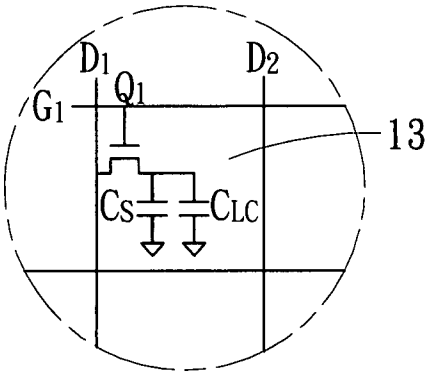
Fig. 1B (Prior Art)
FIG. 1B is a partially enlarged schematic view taken from FIG. 1A.
Figure 2:
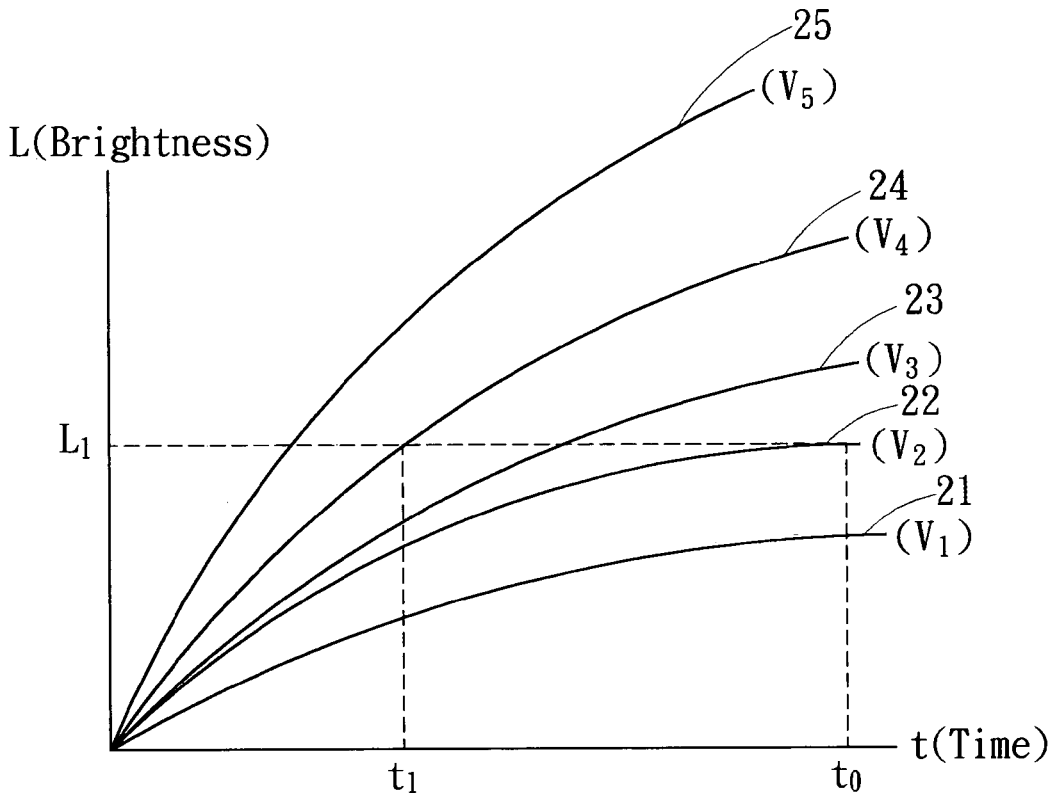
FIG. 2 is a curvilinear figure showing variation curves of brightness of images versus time under various driving voltages of the present invention.

Referring firstly to FIG. 2, different voltages $V_1$, $V_2$, $V_3$, $V_4$ and $V_5$ are used to drive a display panel of an LCD. This can obtain continuously changing curves of brightness versus time under different driving voltages as shown with the FIGS. 21, 22, 23, 24 and 25, such data of changing curves are made a lookup table as a reference in setting the brightness of the panel driven by an advance voltage. Hence the display can fast get its desired brightness.

The First Embodiment

For clearly expressing the technical features of the present invention, an embodiment that the gate lines of the LCD are divided in order that two gate lines are synchronically transmitted in two areas is taken for explanation.

Figure 3:
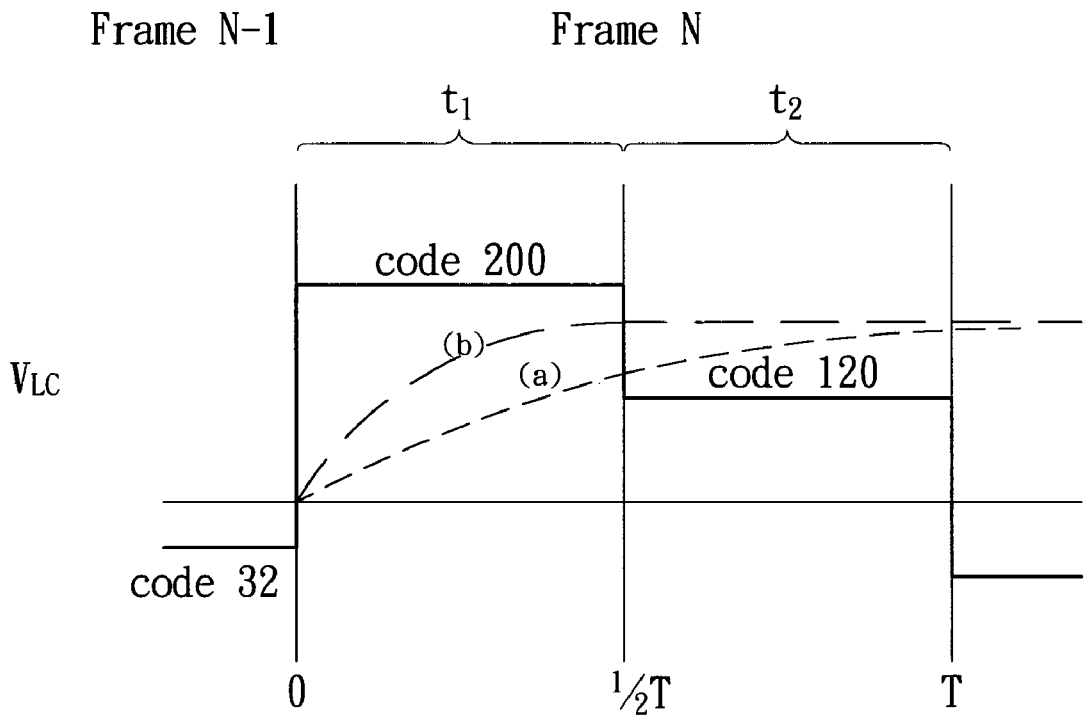
FIG. 3 is a schematic view showing curves of voltage variation and brightness variation of a first embodiment of the present invention in which gate lines are divided into two areas in order that two gate lines are synchronically controlled.
Figure 4A:
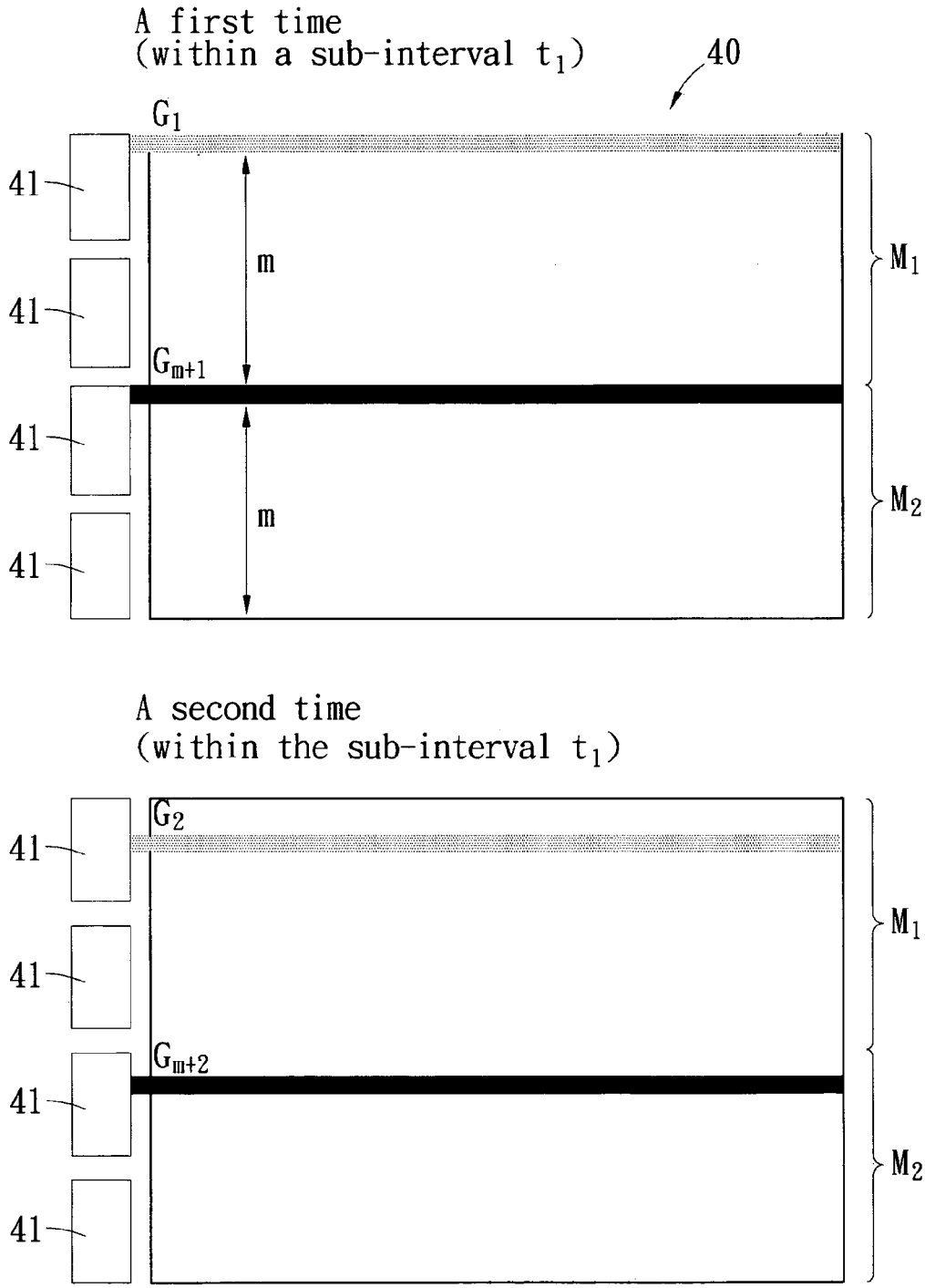
FIG. 4A is a schematic view showing the first embodiment that two gate lines are controlled during a time period of synchronized signals on a display panel at a first time and a second time (within a sub-interval $t_1$) in the present invention.
Figure 4B:
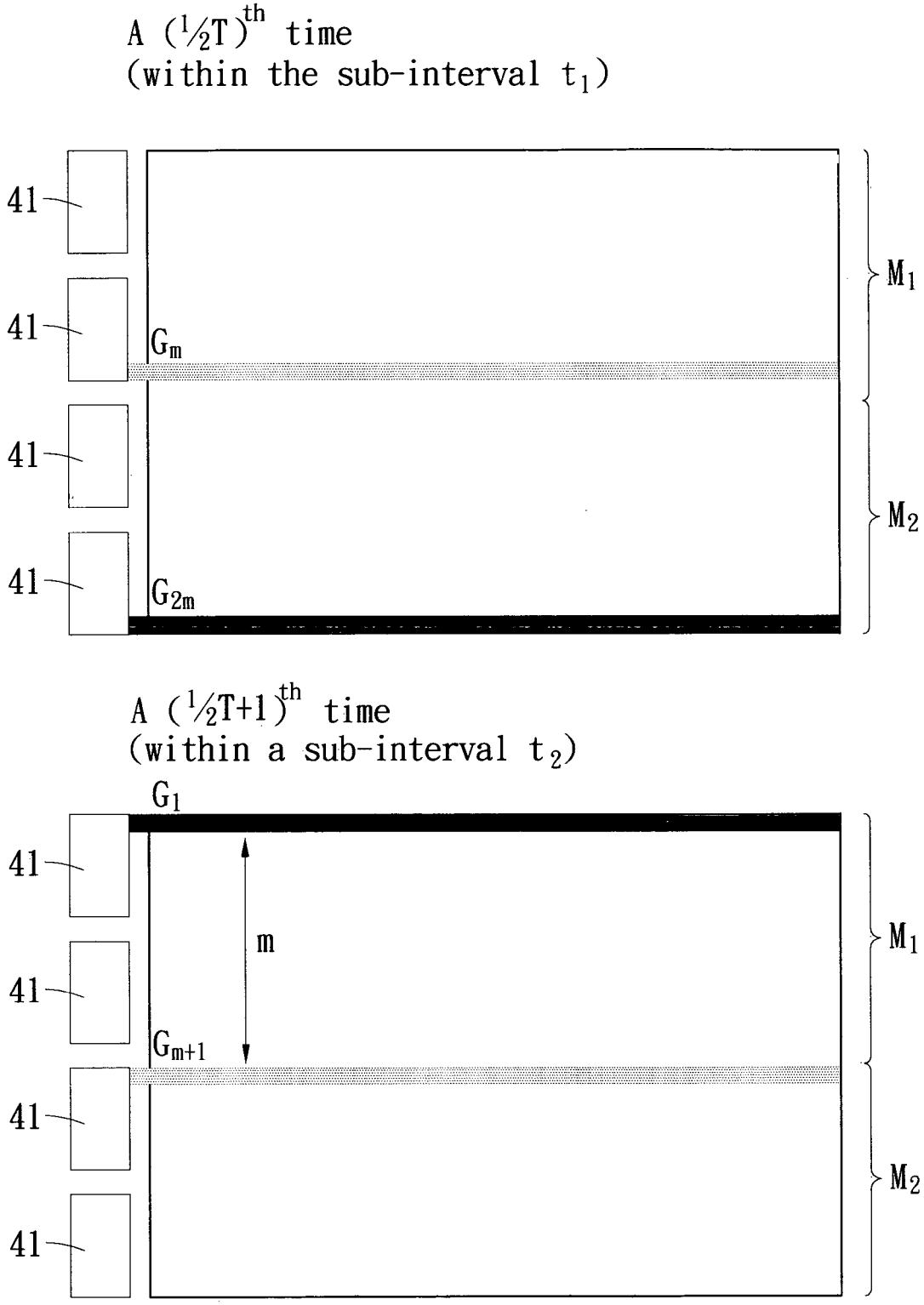
FIG. 4B is a schematic view showing the first embodiment that two gate lines are controlled during a time period of synchronized signals on a display panel at a $(½T)^{th}$ time (within the sub-interval $t_1$) and a $(½T+1)^{th}$ time (within a sub-interval $t_2$) in the present invention.

Referring to FIGS. 3, 4A and 4B, wherein FIG. 3 shows curves of driving voltage waveform and brightness variation (a), (b) of a pixel connected with a gate line on a display panel 40, wherein the transverse coordinate means time in a unit of ms, The frame interval time thereof is T to be divided into two sub-intervals $t_1$ and $t_2$, and $t_1:t_2=1:1$. FIG. 4A shows that the set gate lines on the display panel 40 are divided into two areas $M_1$, $M_2$. Assuming that the amount of the gate lines of the first area is m, and the amount of the gate lines of the second area is also m, the total amount of gate lines is 2m. The ratio of amount made from the two gate lines of the two areas thereby is 1:1.

Assuming that the brightness desired to be presented of a series of image data from a preceding Frame interval (Frame N−1) is code 32, while the brightness during entering the frame interval (Frame N) is code 120. If the curve of brightness variation obtained by driving of the code 120 is one marked as (a), this brightness variation is unable to fast get the brightness desired to be presented. In order to achieve the object of overdriving, an advance voltage (code 200) is selected from the lookup table to drive the display panel 40. The brightness variation will be like that marked as (b). Practicing of the method of the present invention is as below:

In the first sub-interval $t_1$, a gate driver 41 sequentially activates the two gate lines on the display panel 40 during a time period of synchronized signals, an advance voltage (code 200) for overdriving the Frame N is applied to a first gate line $G_1$ in the first area $M_1$, and a data voltage (code 32) for the preceding Frame N−1 is applied to a first gate line $G_{m+1}$ in the second area $M_2$. Then the next gate lines respectively of the areas are sequentially activated and are applied by the voltages of the same value as those of the former gate lines, i.e., gate lines in an area are all applied by same voltage values. Processing goes on till scanning of all the areas is complete.

In the second sub-interval $t_2$, the gate driver 41 sequentially activates the two gate lines on the display panel 40 during a time period of synchronized signals, a data voltage (code 120) for the Frame N for maintaining brightness is applied to the first gate line $G_1$ in the first area $M_1$, and an advance voltage (code 200) for this frame interval is applied to the first gate line $G_{m+1}$ in the second area $M_2$, then the next gate lines respectively of the areas are sequentially activated and are applied by the voltages of the same value as those of the former gate lines, processing goes on till scanning of all the areas is complete.

The situations of completion of scanning for the first area $M_1$ and the second area $M_2$ of the space in this embodiment of practicing are now stated as below: as to the gate lines of the first area $M_1$, at the time $t_1$, by driving of the advance voltage (code 200) for the Frame N to speed up, and the brightness desired is obtained; and at the time $t_2$, by driving of the data voltage (code 120) for the Frame N, the desired brightness to be presented of the Frame N is maintained. Thereby in the frame interval time T in the first area $M_1$, the desired brightness can be fast obtained, and the brightness can be maintained in pursuance of the data voltage.

As to the gate lines of the second area $M_2$, at the time $t_1$, by driving the data voltage (code 32) for the preceding Frame N−1, the brightness of the preceding Frame is presented. And at the time $t_2$, the advance voltage (code 200) for the Frame N drives. The image presented in the second area $M_2$ has a time difference ½ T from that in the first area $M_1$, and subsequent to the first area $M_1$, the desired brightness can also be fast obtained, and the brightness can be maintained in pursuance of the data voltage of the Frame N.

Figure 4C:
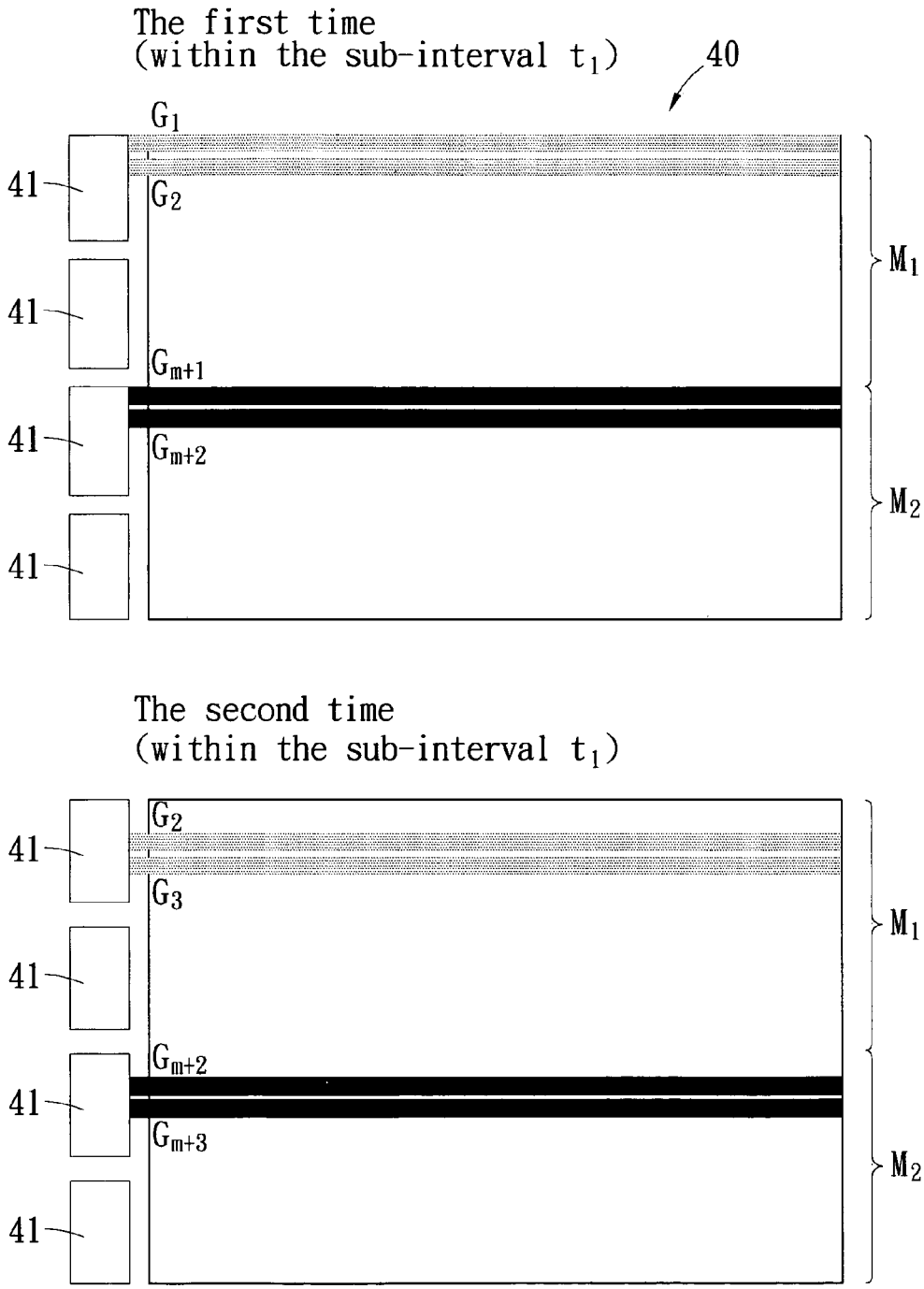
FIG. 4C is a schematic view showing the first embodiment that two gate lines are controlled during a time period of synchronized signals in a scanning area on a display panel at a first time and a second time (within a sub-interval $t_1$) in the present invention.

The synchronic activating of the two gate lines in the above embodiment means that there is a time difference between the two gate lines, in practicing however, we can simultaneously activate and drive plural gate lines in all the scanning areas. Referring to FIG. 4C, in the first sub-interval $t_1$, the gate driver 41 simultaneously activates two gate lines on the display panel 40 in a scanning area, it simultaneously applies an advance voltage (code 200) for the Frame N to the first gate line $G_1$ and the second gate line $G_2$ of the first area $M_1$ to overdrive. After a time difference, the first gate line $G_{m+1}$ and the second gate line $G_{m+2}$ in the second area $M_2$ are simultaneously applied by the data voltage (code 32) for the preceding Frame N−1, then the next two gate lines respectively of each area are sequentially activated, and gate lines of each area are applied by voltages of same value. Processing goes on till scanning of all the areas is complete; the process after entering the next sub-interval is same, in this way, the object of fast getting gray-scale converting can be acquired.

The ratio of amount of the gate lines included in each area to the total number of the gate lines will decide the times $t_1$, $t_2$. If the response speed of the liquid crystal molecules is fast, the ratio can be lowered, on the contrary, can be increased to extend the time required for the liquid crystal molecules to acquire the desired brightness. This value can be adjusted or constant, and is decided by the features of the display panel.

The Second Embodiment

Figure 5:
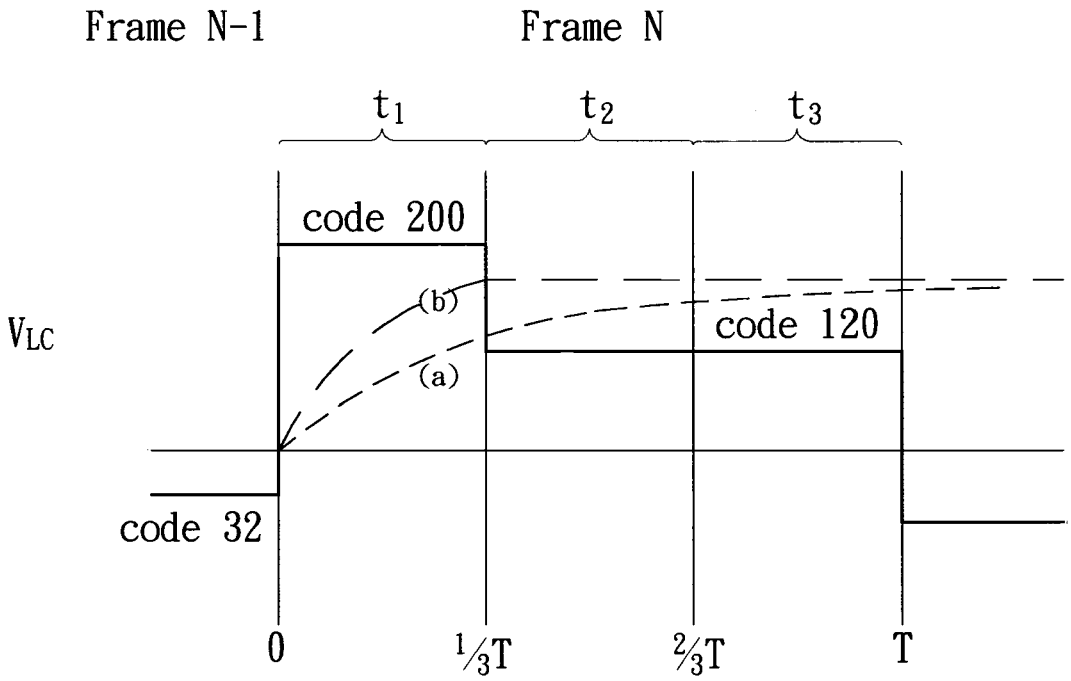
FIG. 5 is a schematic view showing a second embodiment of curves of voltage variation and brightness variation of the present invention in which gate lines are divided into three areas in order that three gate lines are controlled during a time period of synchronized signals for transmitting.
Figure 6A:
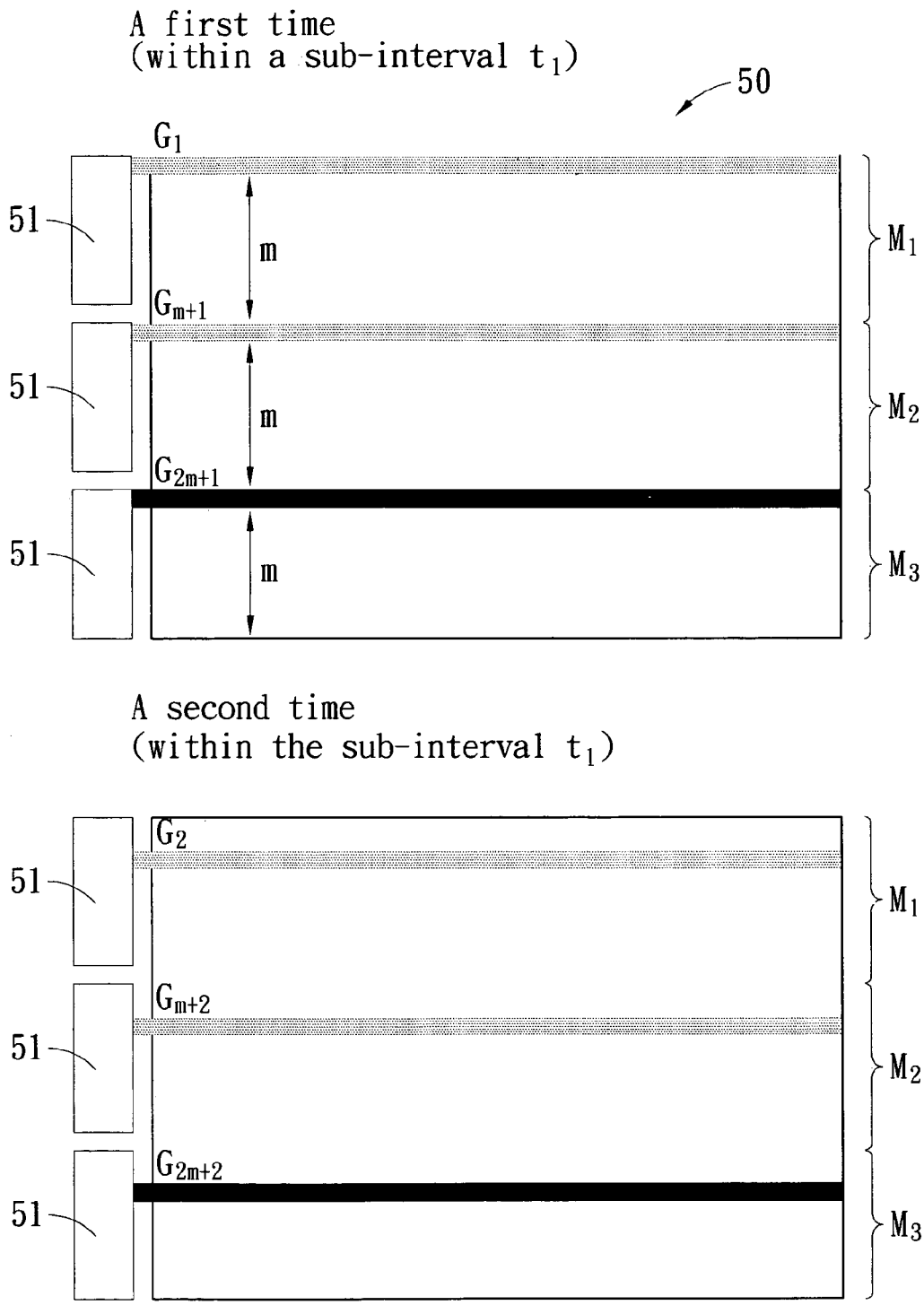
FIG. 6A is a schematic view showing the second embodiment that three gate lines are controlled during a time period of synchronized signals on a display panel at a first time and a second time (within a sub-interval $t_1$) in the present invention.
Figure 6B:
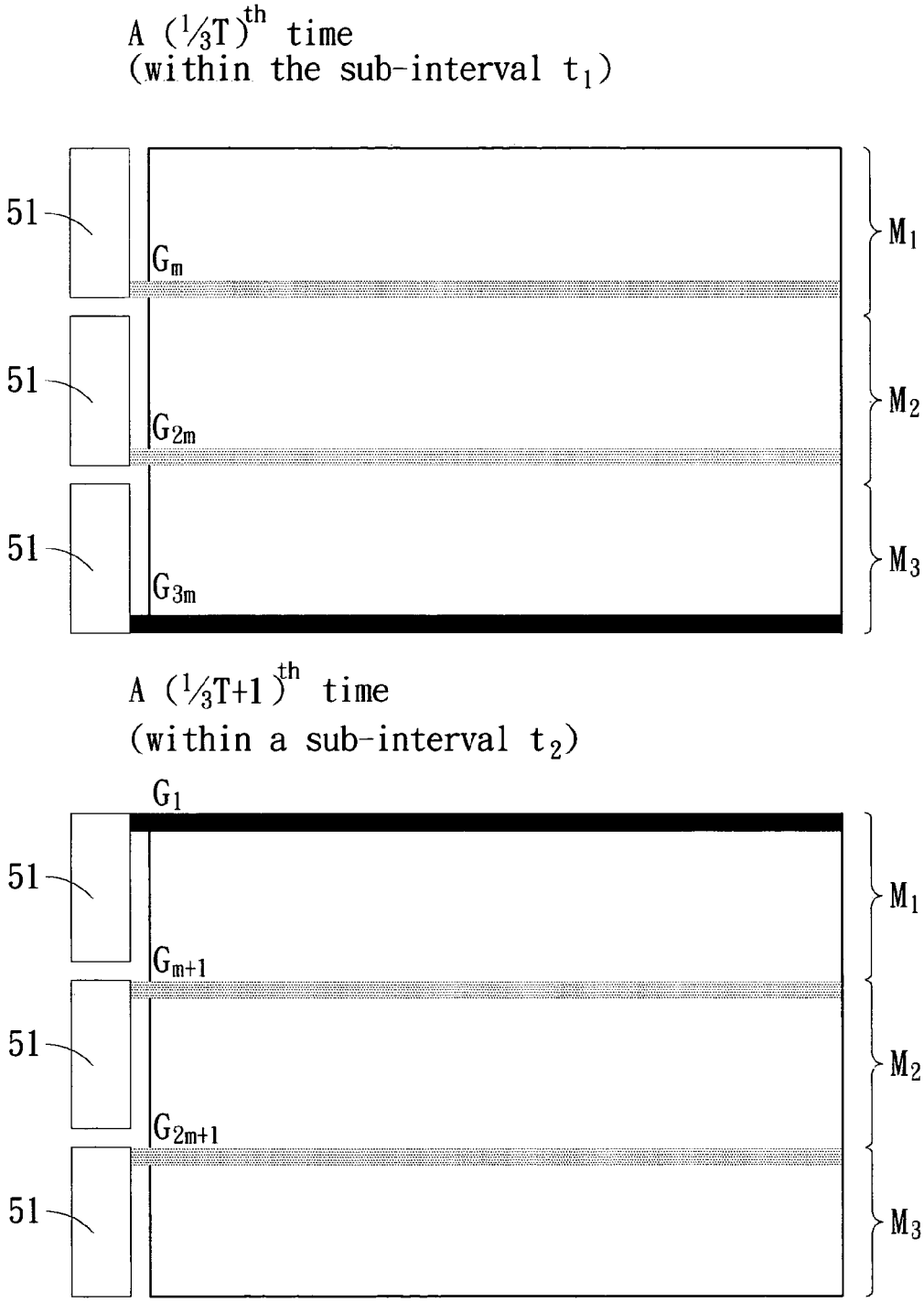
FIG. 6B is a schematic view showing the second embodiment that three gate lines are controlled during a time period of synchronized signals on a display panel at a $(\frac{1}{3}T)^{th}$ time (within the sub-interval $t_1$) and a $(\frac{1}{3}T+1)^{th}$ time (within a sub-interval $t_2$) in the present invention.

In the second embodiment, gate lines are divided into three areas, synchronic controlling of three scanning signals is taken for explanation here. Referring to FIGS. 5, 6A and 6B, in which FIG. 5 shows curves of voltage waveform and brightness variation of a pixel connected with a gate line on a display panel 50. The transverse coordinate indicates time with the unit of ms. The frame interval time is T and is divided into three sub-intervals $t_1$, $t_2$ and $t_3$; $t_1:t_2:t_3=1:1:1$. And referring to FIG. 6A, the gate lines on the display panel 50 are divided into three areas $M_1$, $M_2$, $M_3$. Assuming the amount of the gate lines in the first area is m, and the amount of the gate lines in either of the second and the third areas is m too, the total amount of all the gate lines is 3m, the ratio of the gate lines in these three sub-intervals is 1:1:1.

As shown in FIG. 5, assuming that the brightness desired to be presented of a series of image data from a preceding Frame interval (Frame N−1) is code 32, while the brightness to be presented during entering the frame interval (Frame N)

is code 120, if the display drives the panel with a predetermined data voltage, namely the display is driven by the code 120, the curve of brightness variation obtained is one marked as (a), this brightness variation is unable to fast get the brightness desired to be presented. In order to get the object of overdriving, an advance voltage (code 200) is selected from the lookup table (LUT) to drive the display panel 50. The brightness variation will be like that marked as (b). Practicing of the method of the embodiment of the present invention is as below:

In the first sub-interval $t_1$, a gate driver 51 sequentially activates three gate lines $G_1$, $G_{m+1}$ and $G_{2m+1}$ on the display panel 50 during a time period of synchronized signals, an advance voltage (code 200) for overdriving the Frame N is applied to the first gate line $G_1$ in the first area $M_1$, and a data voltage (code 32) for the preceding Frame N−1 is applied to the first gate lines $G_{m+1}$, $G_{2m+1}$ in the other two areas $M_2$, $M_3$, then the next gate lines respectively of each of the areas are sequentially activated and are applied by the voltages of the same value as that of the former gate line, i.e., gate lines in an area are all applied by same voltage values, processing goes on till scanning of all the areas is complete.

In the second sub-interval $t_2$, the gate driver 51 sequentially activates three gate lines on the display panel 50 during a time period of synchronized signals, a data voltage (code 120) for the Frame N is applied to the first area $M_1$, and the advance voltage (code 200) for the Frame N is applied to the second area $M_2$, the third area $M_3$ is maintained at the data voltage (code 32) for the Frame N−1, then each of the gate lines of the areas are sequentially activated during the time period of synchronized signals, and processing goes on till scanning of all the areas is complete.

In the third sub-interval $t_3$, the data voltage (code 120) for the Frame N is applied to the gate lines of the first area $M_1$, and the data voltage (code 120) for the Frame N is applied to the gate lines of the second area $M_2$, the advance voltage (code 200) for the Frame N is applied to the gate lines of the third area $M_3$, and processing goes on till scanning of all the areas is complete.

The situations of completion of scanning for the areas $M_1$, $M_2$ and $M_3$ of the space in this embodiment of practicing are now stated as below: as to the gate lines of the first area $M_1$, at the time $t_1$, the advance voltage (code 200) for the Frame N drives, and the data voltage (code 120) for the Frame N is applied at the times $t_2$ and $t_3$, thereby the desired brightness to be presented of the Frame N is obtained, and the brightness can be maintained in pursuance of the data voltage.

As to the gate lines of the second area $M_2$, at the first sub-interval $t_1$, the data voltage (code 32) for the preceding Frame N−1 is applied. At the time $t_2$, the advance voltage (code 200) for the Frame N is applied; and at the time $t_3$, the data voltage (code 120) for the Frame N is applied; its completion of scanning has a time difference $t_2$ from that of the areas $M_1$, the image scanning can go on for completion.

As to the gate lines of the third area $M_3$, at the sub-intervals $t_1$, $t_2$, the data voltage (code 32) for the preceding Frame N−1 is applied; and at the time $t_3$, the advance voltage (code 200) for the Frame N is applied; its completion of scanning has a time difference $t_3$ from that of the areas $M_2$, the image scanning can go on for completion and fast get the desired brightness, and the brightness can be maintained in pursuance of the data voltage.

Analogizing according to the above two embodiments, the present invention is suitable for synchronically activating M gate lines, wherein the scanning area of an LCD are divided into M areas, and the object of the present invention can be achieved, the method of this is described as below:

a. to divide the gate lines of an LCD downwardly from above into M areas, the total number of the gate lines is Q, wherein a first area includes $m_1$ gate lines, a second area includes $m_2$ gate lines . . . a $M^{th}$ area includes $m_M$ gate lines, namely $$Q = \sum_{i=1}^{M} m_i,$$

wherein the ratio of the number $m_i$ of gate lines included in each area to the total number Q of the gate lines is $Pi=m_i/Q$, therefore, $$\sum_{i=1}^{M} Pi = 1,$$

the ratio Pi is set according to the features of the LCD, and can be set as a constant value or can be adjusted; M is an integer≧2, and ≦ the maximum value that the display panel can generate during a time period of synchronized signals;

b. to divide the frame interval time T of the LCD into M sub-intervals in correspondence with the M gate lines, wherein the interval time of each sub-interval is $t_i=PiT$, namely, $$\sum_{i=1}^{M} PiT = T;$$

c. to activate each first gate line of the first, the second . . . and the $M^{th}$ areas sequentially during a time period of synchronized signals; then to activate each second gate line of the first, the second . . . and the $M^{th}$ areas sequentially during the next time period of synchronized signals; the operation is repeated, wherein K gate lines are applied by an advance voltage to overdrive frames to speed up response, and J gate lines are applied by an image data voltage; K and J are positive integers, satisfying the relation of K+J=M; the amounts K and J are related to the feature of response of the LCD, they can be decided by measuring and observing the curve of response in advance; as for the second embodiment, J is 1, K is 2, while the advance voltage is obtained by measuring the variation of the gray-scale brightness of the LCD in advance;

d. to repeat the above steps until the end of the entire frame interval time T to enter the next frame interval, the frame image in an $i^{th}$ area having been scanned has a time phase difference ti from the frame image in the former area $(i-1)^{th}$ area.

With the above steps, through dividing of time (frame interval time) and space (gate lines), and by applying the advance voltage and the data voltage, we can fast drive the LCD to increase the image gray-scale response speed. For the present technical level, M had better be a value between 2 and 6. The synchronized signals can also simultaneously activate plural gate lines in each scanned area. The range of the amount of gate lines is from 2 to the amount of the gate lines in the first area, or all the gate lines of the LCD can be activated simultaneously, scanning can be progressed in a multiplied-frequency mode. The driving method of the present invention is applicable to displays of various LCD's, active matrix LCD's and displays of organic light emitting diodes (OLED's).

We can see from the above statement a technical state of "frame in frame" of the present invention. The embodiments given are only for illustrating the present invention, and not for giving any limitation to the scope of the present invention. It will be apparent to those skilled in this art that various modifications or changes without departing from the spirit of this invention shall also fall within the scope of the appended claims.

Therefore, the present invention has the following advantages:

1. It increases the image gray-scale response speed by reducing the time for getting the brightness for a LCD by an "overdrive" technique.
2. A gate driver divides an area of a display panel into a plurality of scanning areas, using the "overdrive" technique to simultaneously apply an advance voltage or a data voltage to every scanning area to increase the gray-scale response speed.
3. The ratio of every scanning area, except the case of separating the display panel, is fixed or adjustable according to the features of the display panel, the method can be applied on various display panels, and is extremely industrial valuable.

In conclusion, according to the description disclosed above, the present invention surely can get the expected object thereof to provide a method of increasing image gray-scale response speed to fast get the desired brightness to be presented of the image data, the method is extremely industrial valuable.

What is claimed is:

1. A method of increasing image gray-scale response speed in a liquid display (LCD), comprising the steps of:

a. dividing gate lines of an LCD downwardly from above into M areas, the total number of said gate lines being Q, wherein a first area includes $m_1$ gate lines, a second area includes $m_2$ gate lines, an $M^{th}$ area includes $m_M$ gate lines, namely $$Q = \sum_{i=1}^{M} m_i,$$

wherein a ratio of said number $m_i$ of gate lines included in each of said areas to a total number Q of said gate lines is $P_i = m_i/Q$, therefore, $$\sum_{i=1}^{M} P_i = 1;$$

b. dividing an entire frame interval time T of said LCD into M sub-intervals in correspondence with said M areas, wherein the interval time of each of said sub-intervals is $t_i = Pi\ T$, namely, $$\sum_{i=1}^{M} Pi\ T = T;$$

c. activating each first gate line of said first, said second . . . . and said $M^{th}$ areas sequentially during a time period of synchronized signals; then activating each second gate line of said first, said second . . . . and said $M^{th}$ areas sequentially during the next time period of synchronized signals; operation of said step being repeated, wherein K gate lines are applied by an advance voltage to overdrive said frames to speed up response, and J gate lines are applied by an image data voltage; K and J are positive integers, satisfying the relation of K+J=M;

d. repeating said steps a-c until an end of said entire frame interval time T to enter the next frame interval, wherein an frame image in an $i^{th}$ area having been scanned has a time phase difference $t_i$ from a frame image in a former area $(i-1)^{th}$ area;

with said steps a-d, through dividing of time (said frame interval time) and space (said gate lines), and by applying said advance voltage and said data voltage, fast driving said LCD to increase said image gray-scale response speed is effected.

2. The method of increasing image gray-scale response speed as in claim 1, wherein:

said ratio Pi is set according to features of said LCD, and is alternatively set to a constant value or adjusted by an external input.

3. The method of increasing image gray-scale response speed as in claim 1, wherein:

said M is an integer equal to or greater than 2, and equal to or less than the maximum value that a panel of said LCD generates during a time period of synchronized signals.

4. The method of increasing image gray-scale response speed as in claim 3, wherein:

said M is preferably a value between 2 and 6.

5. The method of increasing image gray-scale response speed as in claim 1, wherein:

said amounts K and J are related to a feature of response of said LCD, and are decided by measuring and observing a curve of response in advance.

6. The method of increasing image gray-scale response speed as in claim 1, wherein:

said advance voltage is obtained by measuring variation of gray-scale brightness of said LCD in advance.

7. The method of increasing image gray-scale response speed as in claim 1, wherein:

at least one of said J gate lines is selected to apply a data voltage for a preceding Frame.

8. The method of increasing image gray-scale response speed as in claim 1, wherein:

said method is suitable for active matrix LCD's and displays of organic light emitting diodes (OLED's).

9. The method of increasing image gray-scale response speed as in claim 1, wherein:

synchronized signals are adapted to simultaneously activate a plurality of gate lines in any of said scanned areas, the range of amount of said activated gate lines is from 2 to an amount of said gate lines in said first area.

10. The method of increasing image gray-scale response speed as in claim 1, wherein:

all said gate lines of said LCD are activated simultaneously, or scanning is progressed in a multiplied-frequency mode.

* * * * *